US010213786B2

(12) United States Patent
Yang

(10) Patent No.: US 10,213,786 B2
(45) Date of Patent: Feb. 26, 2019

(54) PAPER SHREDDER CUTTING ASSEMBLY

(71) Applicant: Zhikai Yang, Shanghai (CN)

(72) Inventor: Zhikai Yang, Shanghai (CN)

(73) Assignee: Aurora Office Equipment Co., Ltd. Shanghai, Shanghai (CN)

( * ) Notice: Subject to any disclaimer, the term of this patent is extended or adjusted under 35 U.S.C. 154(b) by 881 days.

(21) Appl. No.: 14/663,444

(22) Filed: Mar. 19, 2015

(65) Prior Publication Data

US 2016/0236200 A1 Aug. 18, 2016

(30) Foreign Application Priority Data

Feb. 12, 2015 (CN) ..... 2015 1 0074477

(51) Int. Cl.
*B02C 18/00* (2006.01)
*B02C 18/18* (2006.01)
*B02C 18/14* (2006.01)

(52) U.S. Cl.
CPC ..... *B02C 18/0007* (2013.01); *B02C 18/142* (2013.01); *B02C 18/146* (2013.01); *B02C 18/182* (2013.01); *B02C 2018/0046* (2013.01)

(58) Field of Classification Search
CPC . B02C 18/0007; B02C 18/142; B02C 18/146; B02C 18/182; B02C 2018/0046; B02C 2018/0015
USPC ..... 241/236
See application file for complete search history.

(56) References Cited

U.S. PATENT DOCUMENTS 5,163,629 A * 11/1992 Raterman ..... B02C 18/0007 241/167
5,934,580 A * 8/1999 Maier ..... B02C 18/0007 241/100
2005/0242221 A1* 11/2005 Rota ..... B02C 18/142 241/236
2006/0049291 A1* 3/2006 Rajewski ..... B02C 18/0007 241/167
2007/0295845 A1* 12/2007 Huang ..... B02C 18/0007 241/295
2008/0197221 A1* 8/2008 Hartnett ..... B02C 18/0007 241/91
2011/0062263 A1* 3/2011 Bartelt ..... B02C 18/142 241/236

* cited by examiner

*Primary Examiner* — Faye Francis
(74) *Attorney, Agent, or Firm* — WHGC, P.L.C.; John F. O'Rourke

(57) ABSTRACT

A paper shredder cutting assembly having an arbor, spaced-apart cutting blades on the arbor, a rigid frame set apart from and parallel to the arbor, and braces coupling the arbor to the frame. Each resilient brace is a spacer between a pair of spaced-apart cutting blades. The braces support arbor and cutting blades. The rigid frame and the braces cooperate to strengthen, and to reduce translational motion of the arbor, while allowing rotation of the arbor. Each brace has a brace body, a brace tang extending therefrom, and a brace tab extending perpendicularly from the brace tang. Each brace tab is aligned with another along an edge of the rigid frame, the brace bodies are spacers between the cutting blades, and the brace tabs impair translational motion of the brace bodies. A paper shredder with a motor, gearing, and counterposing cutting assemblies has motion-limited resilient spacers adjacent to cutting blades.

17 Claims, 10 Drawing Sheets

PAPER SHREDDER CUTTING ASSEMBLY

BACKGROUND

1. Field of the Invention

The present invention pertains to paper shredders and, more particularly, to paper shredder cutting assemblies.

2. Background Technology

A paper shredder is usually used to destroy paper and documents. Typical paper shredders comminute a load of material, for example, paper, into shreddant using counter-rotating assemblies of cutting blades mounted on an arbor, and driven by a motor and a power transmission. The cutting blade assemblies usually are composed of multiple, spaced apart cutting blades, which shred the material while rotating. During rotation, clumps of material, excess material, or density differences in regions of material may cause the shredder cutting blade assemblies to experience unanticipated translational forces. These excess translational forces can cause warpage of the shredder cutting blade assemblies, leading to forceful rotation, cutter jamming, and overheating of the shredder motor. Traditionally, translational forces have been managed by using larger motors, thicker blade arbors, or both, which increases the weight and cost of the shredder. Also, paper guides also are mounted albeit loosely to the arbor. The paper guides typically are connected with a connecting rod to prevent rotation with cutting blade assemblies. However, the paper guides tend to not restrict positions of adjacent paper guides and provide paper guide configurations that are not stable.

SUMMARY

A shredder cutting assembly is provided, which includes an arbor, spaced-apart cutting blades disposed on the arbor, a rigid frame set apart from and parallel to the arbor, and a plurality of braces coupling the arbor to the frame. A brace takes the place of a paper guide in the prior art. Each of the braces is disposed as a spacer adjacent to a respective pair of the spaced-apart cutting blades. The plurality of braces support the arbor. The rigid frame and the plurality of braces cooperate to strengthen the arbor, while allowing rotation of the arbor. In embodiments, the braces are resilient and each of the braces has a C-shaped central slot to accommodate the arbor.

In an embodiment, each of the braces has a slot shaped to accommodate at least a portion of the rigid frame. Each of braces has a brace body, a brace tang extending from the brace body, and a brace tab extending perpendicularly from the brace tang. Each of the brace tabs is aligned with another along an edge of the rigid frame, the brace bodies are disposed as spacers between the plurality of cutting blades, and the brace tabs impair translational motion of the brace bodies. In some embodiments, the slot can be at least one J-shaped slot. In other embodiments, the slot can be a peripheral slot. In yet other embodiments, the peripheral slot can be a faceted C-shaped peripheral slot. Also, in certain embodiments, the body of each of the plurality of braces includes at least one downward protuberance. The rigid frame and the braces cooperate to reduce a translational motion of the arbor. Also, the rigid frame and the braces cooperate to impair coaxial translational motion in the spaced-apart cutting blades.

Embodiments can include a shredder cutting assembly, having a pair of arbors, spaced-apart cutting blades disposed on each arbor forming a cutting blade assembly, and resilient braces movably attached to the arbor, with a respective resilient brace being disposed adjacent to a respective one of the plurality of spaced-apart cutting blades, wherein the resilient braces cooperate to reduce translational forces on the arbors. Embodiments also include gearing attached to, and causing counterposing rotation of, the arbors, and a motor attached to and driving the gearing.

Also provided is a paper shredder, having a motor, gearing coupled to and driven by the motor, a pair of counter-rotating arbors driven by the gearing, respective spaced-apart cutting blades attached to move with each respective arbor, and respective braces interposed between the respective spaced-apart cutting blades and movably attached to the respective arbors. Each of the braces has a vertical body, a tang extending from the vertical body, and a horizontal tab extending from the tang. The vertical body is sized to prevent a cutting blade from touching the horizontal tab. The respective braces cooperate to reduce a translational motion of the respective arbor. The respective braces are resilient, and can be composed of a nylon-fiber material or an acrylonitrile butadiene styrene material. In certain embodiments, the paper shredder also includes a rigid frame set apart from and parallel to each arbor. Each respective plurality of braces couples an arbor to a frame. Each frame and braces cooperate to strengthen the arbor and to limit a translational motion of each arbor, while allowing rotational motion of each arbor.

BRIEF DESCRIPTION OF THE DRAWINGS

Embodiments of the present invention disclosed herein are illustrated by way of example, and are not limited by the accompanying figures, in which like references indicate similar elements, and in which.

Skilled artisans can appreciate that elements in the figures are illustrated for simplicity and clarity and have not necessarily been drawn to scale. For example, the dimensions of some of the elements in the figures may be exaggerated relative to other elements to help improve the understanding of the embodiments of the present invention. In the figures, like numbers correspond to like elements.

DETAILED DESCRIPTION

A shredder cutting assembly is provided that provides a resilient spacer between cutting assembly blades. The resilient spacer supports and strengthens the arbor and reduces arbor warpage due to X-Y-Z translational forces which may occur during comminution. The resilient spacer can reduce the need for larger motors, thicker blade arbors, or both, tending to decrease the weight and cost of the shredder.

Figure 1:
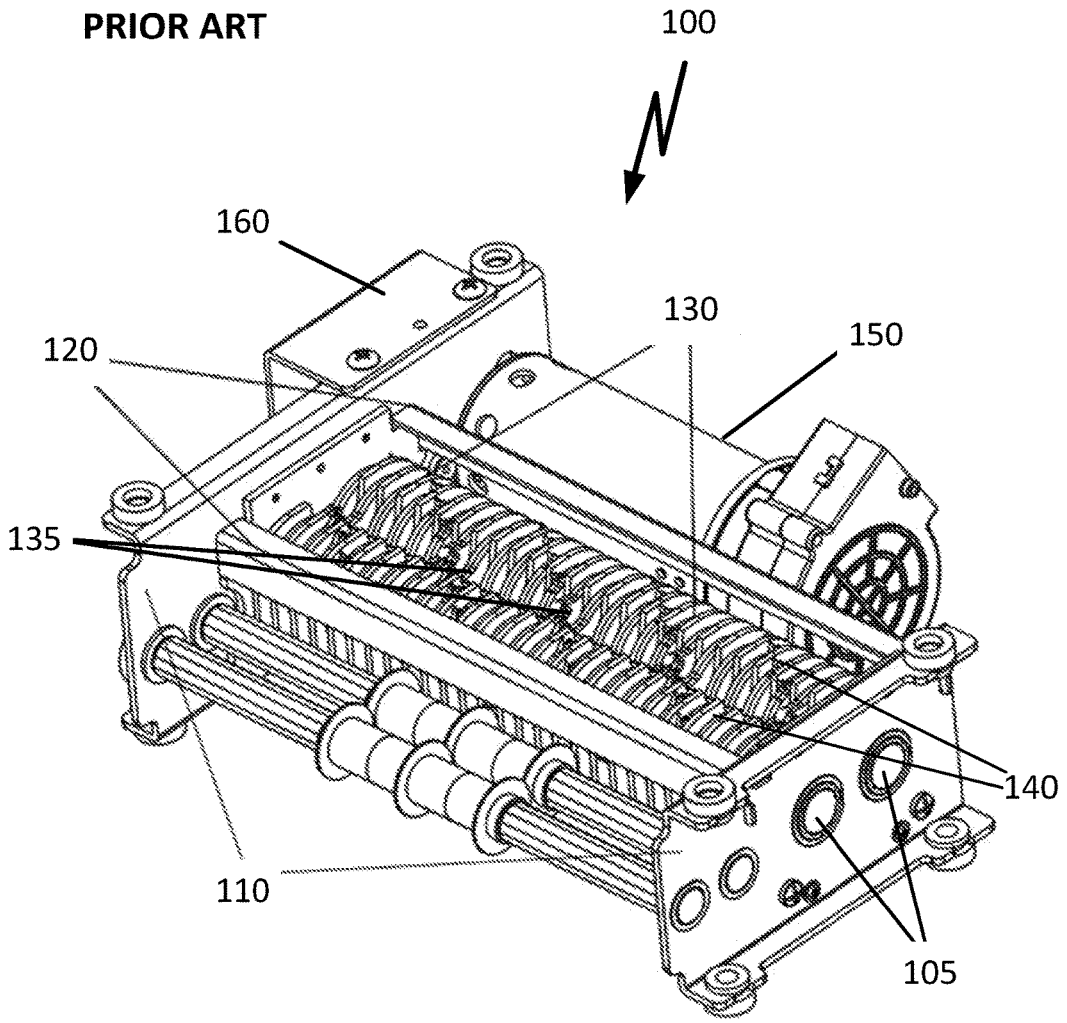
FIG. 1 is a perspective illustration of a prior art paper shredder cutting assembly.

In FIG. 1, a prior art embodiment of main shredder assembly 100 for a paper shredder is shown. Main shredder assembly 100 can have vertical support panels 110 affixed to horizontal support bars 120 constituting a supporting enclosure for two counterposing, or counter-rotating, cutting blade assemblages 130. Blade assemblages 130 can be a respective plurality of cutting blades 135 supported on arbors 105. Each cutting blade assemblage 130 can be formed from a plurality of cutting blades 130 on respective arbors 105. Counterposing cutting blade assemblages 130 are moved in opposing directions by torque generated by a power mechanism such as motor 150 and imposed through a transmission system, such as gearing 160 on arbors 105. Main shredder cutting assembly 100 can have a plurality of cutting assembly paper guides 140, with each paper guide 140 being disposed between adjacent cutting blades as a spacer.

Figure 2:
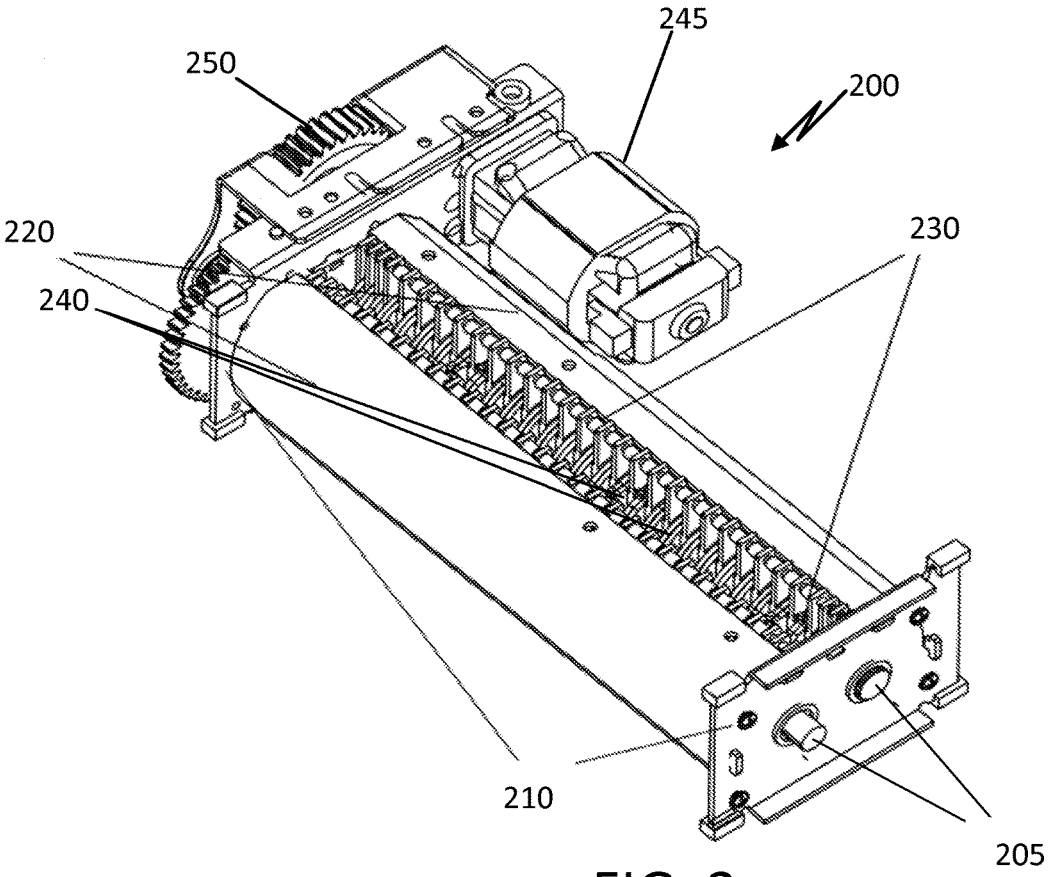
FIG. 2 is a perspective illustration of an embodiment of a paper shredder cutting assembly, in accordance with the teachings of the present invention.

FIG. 2 illustrates an embodiment of main shredder cutting assembly 200 where vertical support panels 210 are affixed to C-cross-sectioned cowling frames 220, for example, by a screw. Cowling frames 220 also provide greater structural rigidity than can the horizontal bar of the prior art, and allow for a more compact structure. As with FIG. 1, blade assemblages 240 can be driven by arbors 205. Arbors 205 cause opposing rotational movement of blade assemblages 240, upon urging by gearing 250 under power from motor 245. Cowling frames 220 can be shaped to orient cutting assembly braces 230 to be parallel to cutting blades 240. Cowling frames 220 also provide greater coverage of cutting blades 240, preventing inadvertent injury from touching an exposed section of blades 240. Cutting assembly braces 230 can be disposed such that each brace 230 can be adjacent to blade 240—or seen alternatively, as one brace 230 between two blades 240. Braces 230 can have a positioning device shaped and positioned to reduce an X-Y-Z translational motion, or combinations thereof, of braces 230 due to torque on arbors 205 and gearing 250. The result can be to reduce the size needed for arbor 215, the size of the transmission system, such as gearing 250, and, by extension, the power mechanism, such as motor 245, needed to turn arbors 205 during comminution. Also as a result, a motor 245 can extend its duty cycle for comminution, or alternatively, be made smaller in size. An X translational force can be described as a coaxial translational force. Gearing 250 may be any form of transmission including, without limitation, gears or belts. Motor 245 can be any suitable form of power mechanism which delivers motive force.

Figure 3:
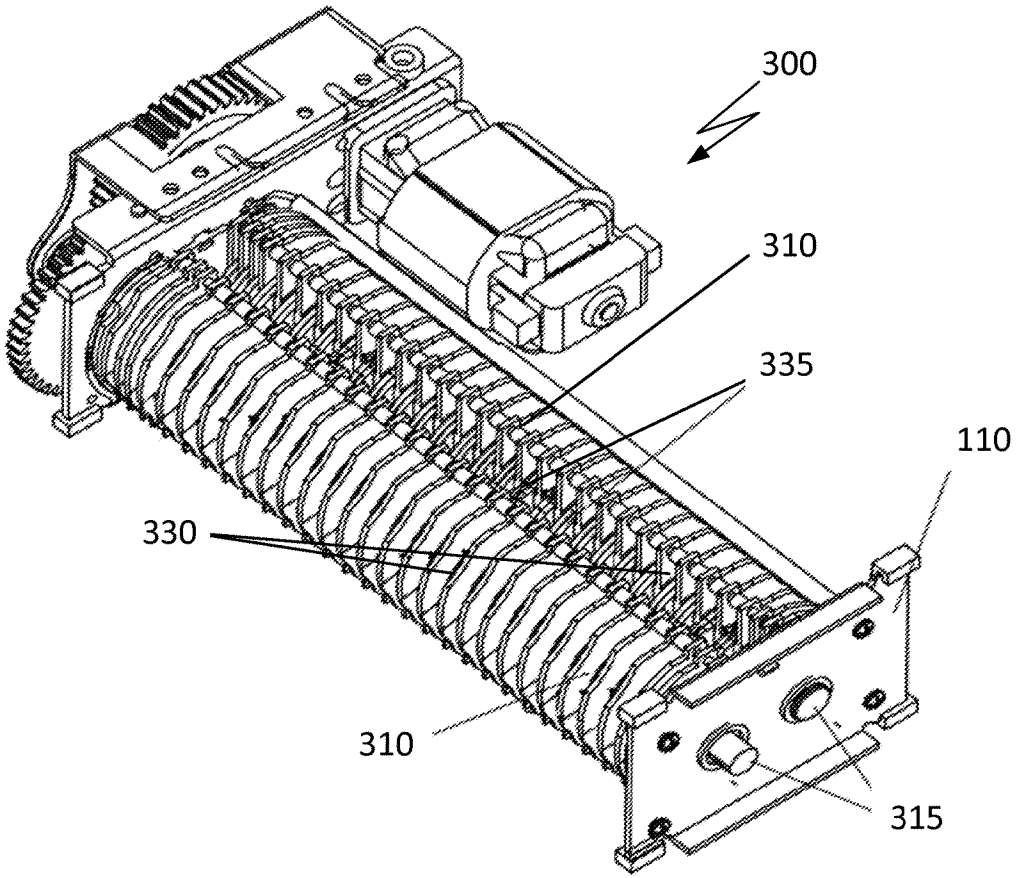
FIG. 3 is a perspective illustration of the paper shredder cutting assembly of FIG. 2 with horizontal cowling removed, in accordance with the teachings of the present invention.

FIG. 3 illustrates another embodiment of main shredder cutting assembly 300, similar to assembly 200, with the cowling frame (220) in the forefront removed for clarity. In main shredder cutting assembly 300, arbors 315 are each disposed with multiple cutting blades 335. Adjacent cutting blades 335 can be set apart by cutting assembly braces 310. Braces 310 can be mounted on arbors 315 and cowling frame 320 to provide support not present in prior art paper guides. Braces 310 can be shaped to support and strengthen arbors 315 and, thus, reduce lateral translational movement of arbor 315 and cutting blades 335. Also, braces 310 also can be shaped to reduce coaxial translational movement by arbors 315 and cutting blades 335, while not hindering rotational movement of blade assemblages 330. Further, braces 310 can be shaped to keep user fingers from sharp cutting blades 335, when the assembly 300 is mounted in a housing (not shown).

Figure 4:
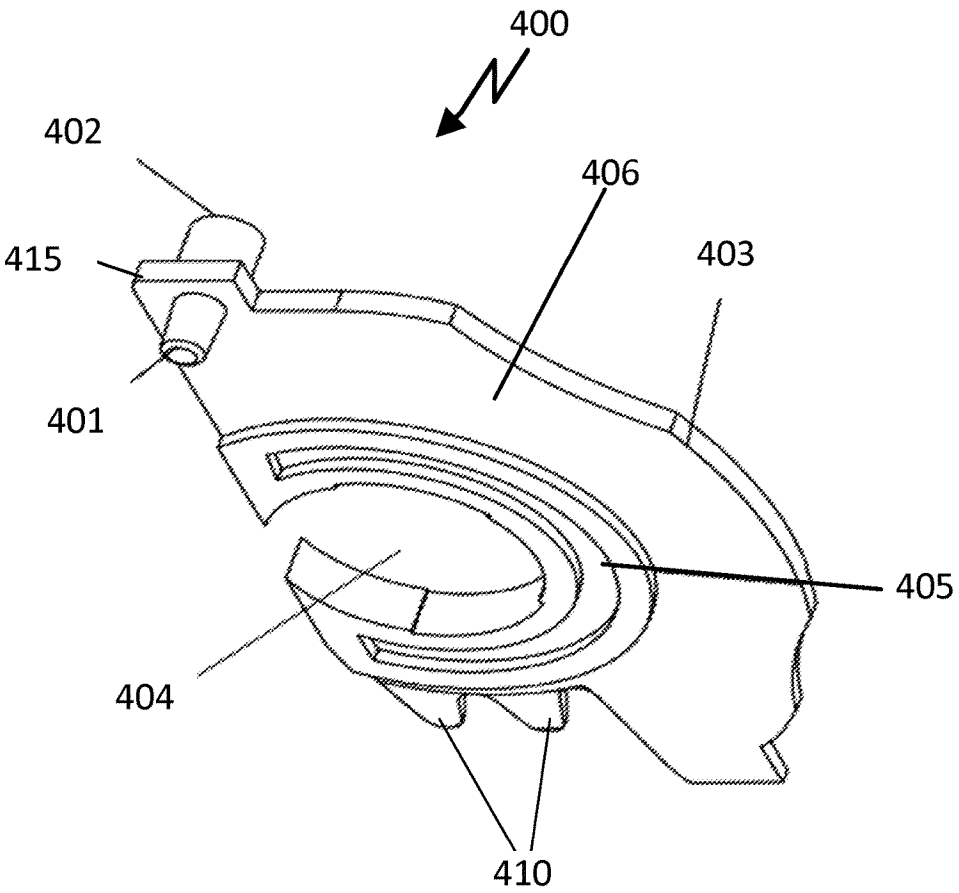
FIG. 4 is an embodiment of a cutting assembly brace, in accordance with the teachings of the present invention.

FIG. 4 illustrates an embodiment of brace 400 having a body 406 shaped to fit between adjacent cutting blades, such as blades 335 in FIG. 3. Brace 400 may be made of a nylon-fiber material or a resilient plastic such as acrylonitrile butadiene styrene (ABS), although other strong, wear-resistant, resilient materials can be acceptable. Brace body 406 can be formed with tang 415 having tab structure composed of a positioning device, such as pin 401 and cap 402, each extending essentially perpendicularly from tang 415. Pin 401 of a first brace can be shaped to engage cap 402 of a proximate second brace. Brace pin 401 of a first brace and brace cap 402 of a second brace can be, but are not required to be, interconnected with each other. As a result, for example, braces 230 and 310 remain aligned and with limited motion during comminution. In between each brace 400 can be a cutting blade (not shown). Each brace 400 can have a spine 403, which provides semi-rigidity to the structure 400, while allowing a degree of resilience. Spine 403 also orients with a cowling frame (not shown) relative to cutting blades (not shown). Brace 400 can have a C-shaped central opening 404 formed to receive an arbor shaft (not shown), thereby providing support to the arbor shaft. During operation, a rotating shaft may experience X-, Y-, or Z-translational forces, or a combination thereof, which may be at least partly absorbed by brace 400 as facilitated by C-shaped slot 405. Sound and vibration also may be attenuated. In addition, coaxial translational forces can be reduced by the contact of tab structures 401, 402 with each other. As coaxial translational forces occur, the tab structures 401, 402 can be pushed together in the direction of the force, causing a force opposing translational motion and offsetting the translational force. Brace body 406 also can have downward protuberances 410. Protuberances 410 act to remove or push out particles of shreddant, preventing particles of shreddant from becoming caught between cutting blades 335 (not shown) in a cutting blade assemblage 330.

Figure 5:
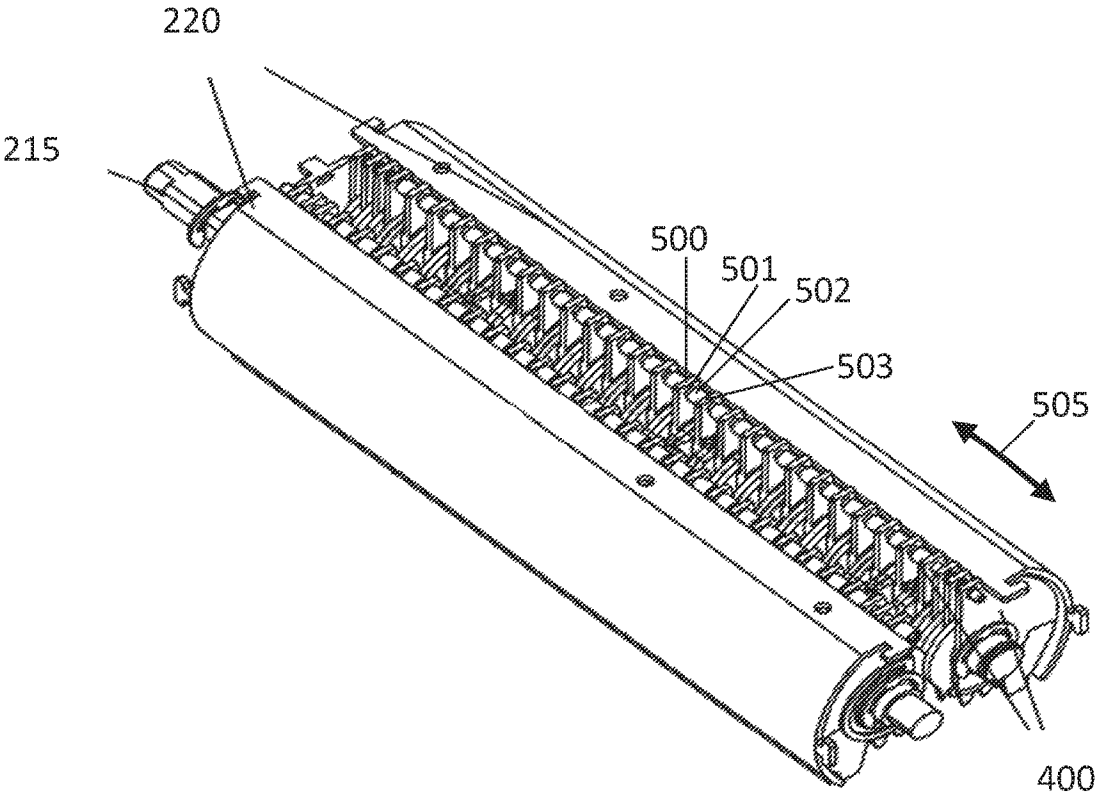
FIG. 5 is an embodiment of a paper shredder cutting assembly using the cutting assembly brace of FIG. 4, in accordance with the teachings of the present invention.

FIG. 5 depicts the embodiment of main shredder cutting assembly 500, with motor and gearing removed. Cowling frames 520 provide horizontal support of an enclosure with the vertical support provided by panels, like panels 110 (not shown). With the vertical panels removed, the positioning and alignment of braces generally at 400 may be shown. As with FIG. 4, tab structures 401, 402, can be respectively representative of tab section 501 of brace 503, and tab section 502 of brace 503. The assembly of tab sections can be in linear proximity with each other. During coaxial translational force, such as in the X-directions indicated by line 555, the cap-and-pin configuration of tab parts 501 and 502 tend to come into contact with each other, maintaining blades in left-to-right alignment and absorbing some of the coaxial translational force.

Figure 6:
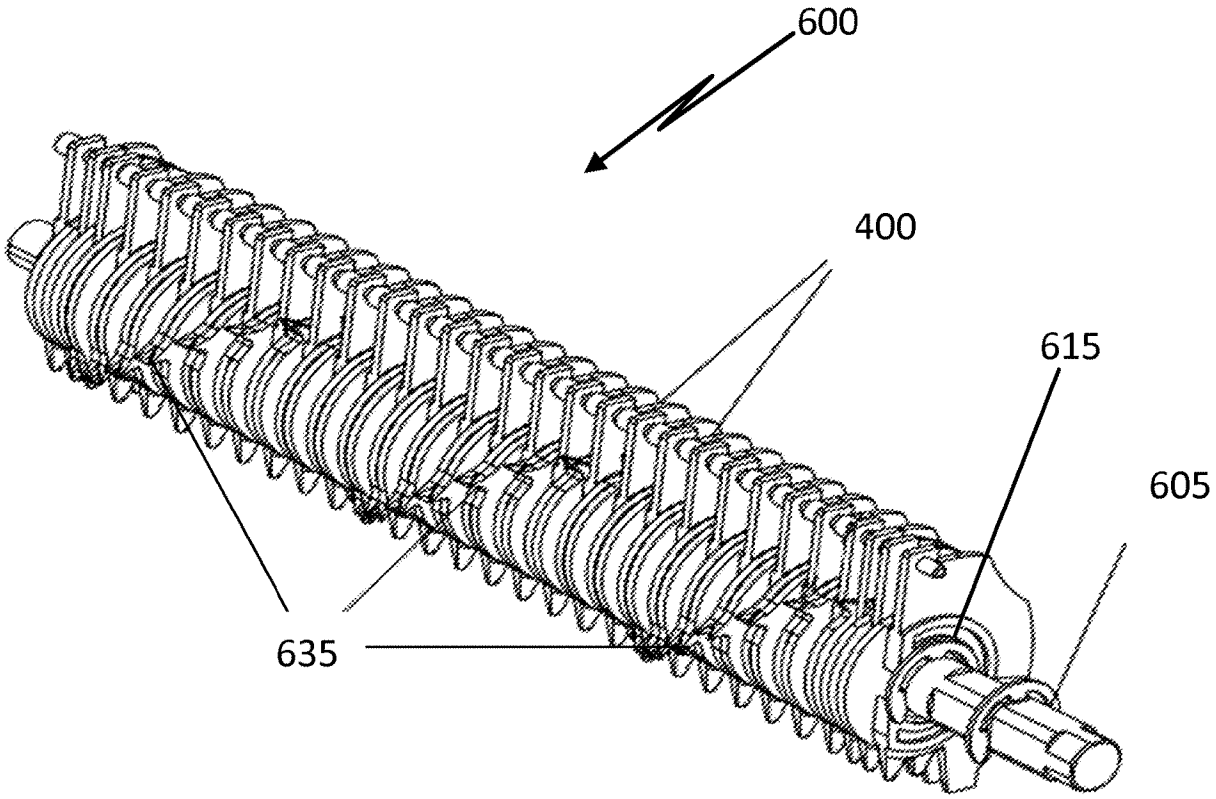
FIG. 6 is a single cutting cylinder from the embodiment of FIG. 5 illustrating cutting assembly braces, in accordance with the teachings of the present invention.

FIG. 6 is a depiction of a single cutting blade assemblage 600, composed of arbor 605, and multiple cutting blades 635, each of which having a braces, such as braces 400, in between proximate pairs of cutting blades 635. Cutting assembly 600 can be seen as having cutting blades 635 fitting onto arbor 605 and held in place (on either end) by C-clamp 615. While allowing rotational motion, braces 400 support arbor 605 and tend to inhibit translational movement in the X-Y-Z direction as well as arbor warpage, which may result during operation of arbor 605.

Figure 7:
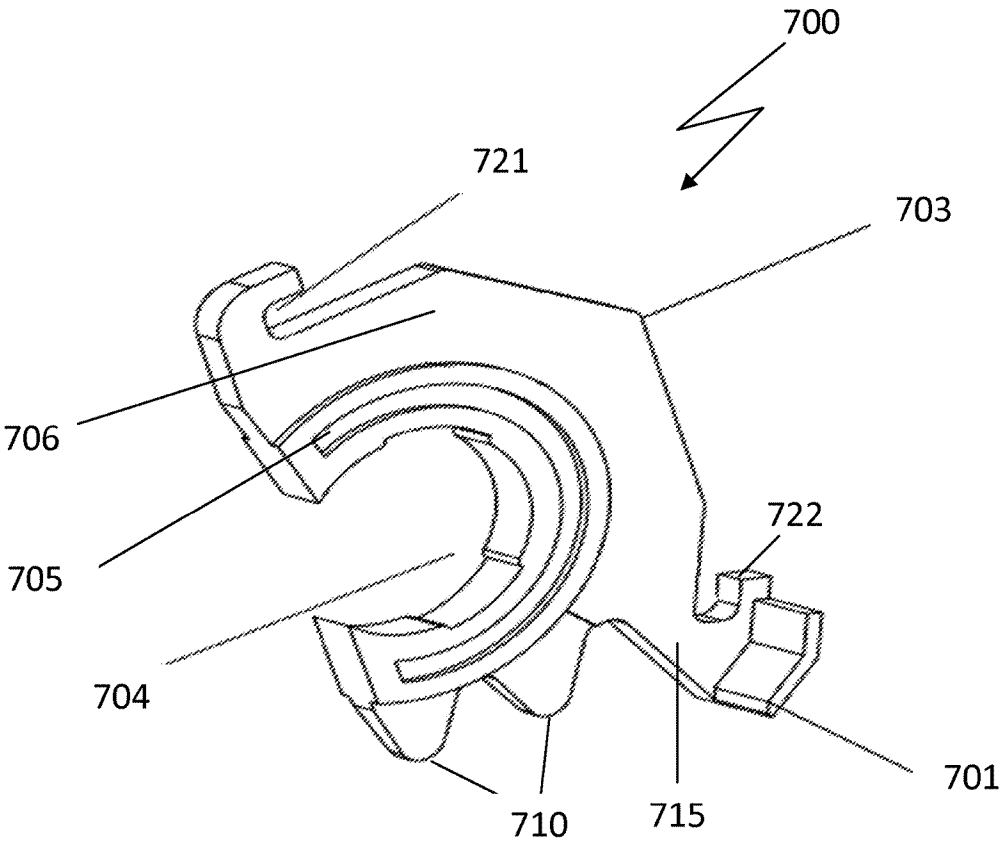
FIG. 7 is another embodiment of a cutting assembly brace, in accordance with the teachings of the present invention.

FIG. 7 illustrates another embodiment of brace 700. In general, brace 700 includes a body 706, a tang 715 extending from body 706, and positioning device, such as tab 701, extending essentially perpendicularly from tang 715. Spine 703 is shaped to fit into a cowling frame (not shown). Brace 700 is formed with a C-shaped opening 704 for receiving an arbor (not shown). Typically, on either side of brace 700 can be one of a plurality of cutting blades on an arbor (not shown). Also, through body 706, and generally lying in parallel with opening 704, is C-shaped slot 705, which provides resilient control of translational movements of the arbor (not shown) including coaxial translational movement. Tab 701 is formed to abut tang 715 of an adjacent brace 700 without interfering with the rotational movement of a cutting blade which may be proximate to tab 701. As coaxial translational forces occur, the tab structures 701 can be pushed into adjacent tab tang 715, in the direction of the force, opposing translational motion and reducing the generated translational force. This, in turn, tends to reduce arbor warpage.

Body 706 also can be formed with at least one J- or U-shaped hook structure 721, 722, which can be disposed at the ends of spine 703 on body 706. Structure 721, 722 can be used to attach to a shredder structure such as cowling frames 220, 520. Hook structures 721, 722 restrict motion in brace 700 in an up-and-down orientation, while tab 701 tends to restrict motion in a left-and-right orientation. In general, the hook portion of hook structure 721, 722 is sized to fit the thickness of cowling frames 220, 520. In such a configuration, the arbor (not shown), to which the cutting blades (not shown) are attached, can be provided with additional support during operation and can have translational movement reduced. Together, the braces 700 and rigid frame of the horizontal support (not shown) tend to cooperate to reduce a translational force. Sound and vibration also may be attenuated. Brace 700 also can have protuberances 710 from body 706. Protuberances 710 act to remove or push out particles of shreddant, preventing particles of shreddant from becoming caught between cutting blades, for example, cutting blades 635 (not shown). Each brace 700 can have spine 703, which provides semi-rigidity to the structure 700, while allowing a degree of resilience. Spine 703 may be faceted, and the facet may coincide with the shape of the cowling to which brace 700 may be attached. Body 706 can be large enough to prevent cutting blades (not shown) from coming into contact with tab 701.

Figure 8:
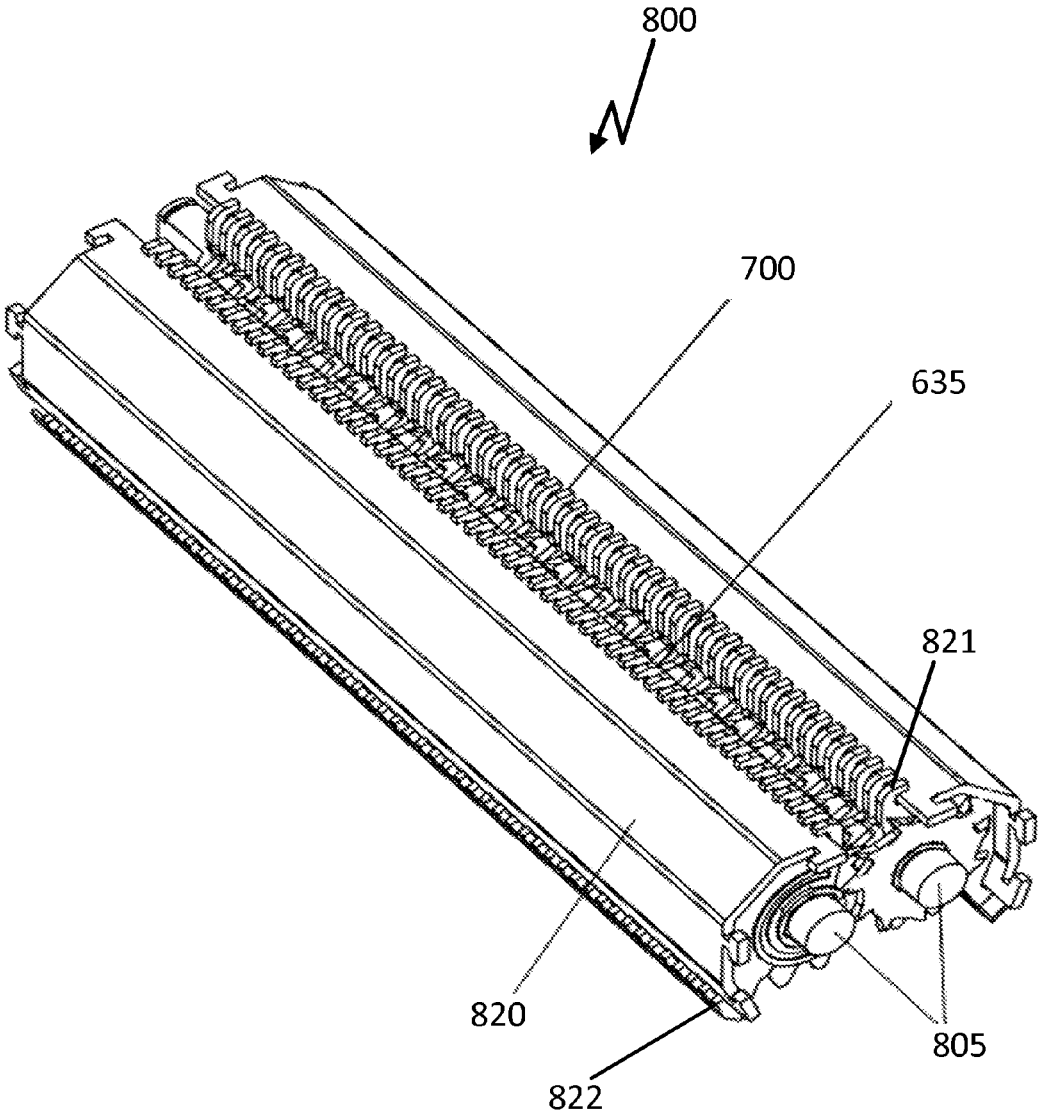
FIG. 8 is another embodiment of a paper shredder cutting assembly using the cutting assembly brace of FIG. 7, in accordance with the teachings of the present invention.

FIG. 8 illustrates a shredder cutting assembly 800, which includes counterposing cutting blade assemblies having a plurality of blades 635 and a plurality of braces generally at 700 shown respectively positioned between the plurality of blades 635. Blades and braces are fitted onto arbors 805. Cutting assembly 800 can have cowling frames 820 onto which braces 700 are attached. Brace portion 821 of one brace in FIG. 8 generally corresponds to the upper J- or U-shaped structure 721 of brace 700 in FIG. 7, whereas brace portion 822 of another brace in FIG. 8 generally corresponds to the lower J- or U-shaped structure 722 of brace 700 in FIG. 7. When in position on arbors 805, braces 700 set cowling 820 apart from cutting blades 635 and arbor 805. The braces 700 and rigid frame of cowling 820 tend to cooperate to reduce a translational force on arbor 805.

Figure 9:
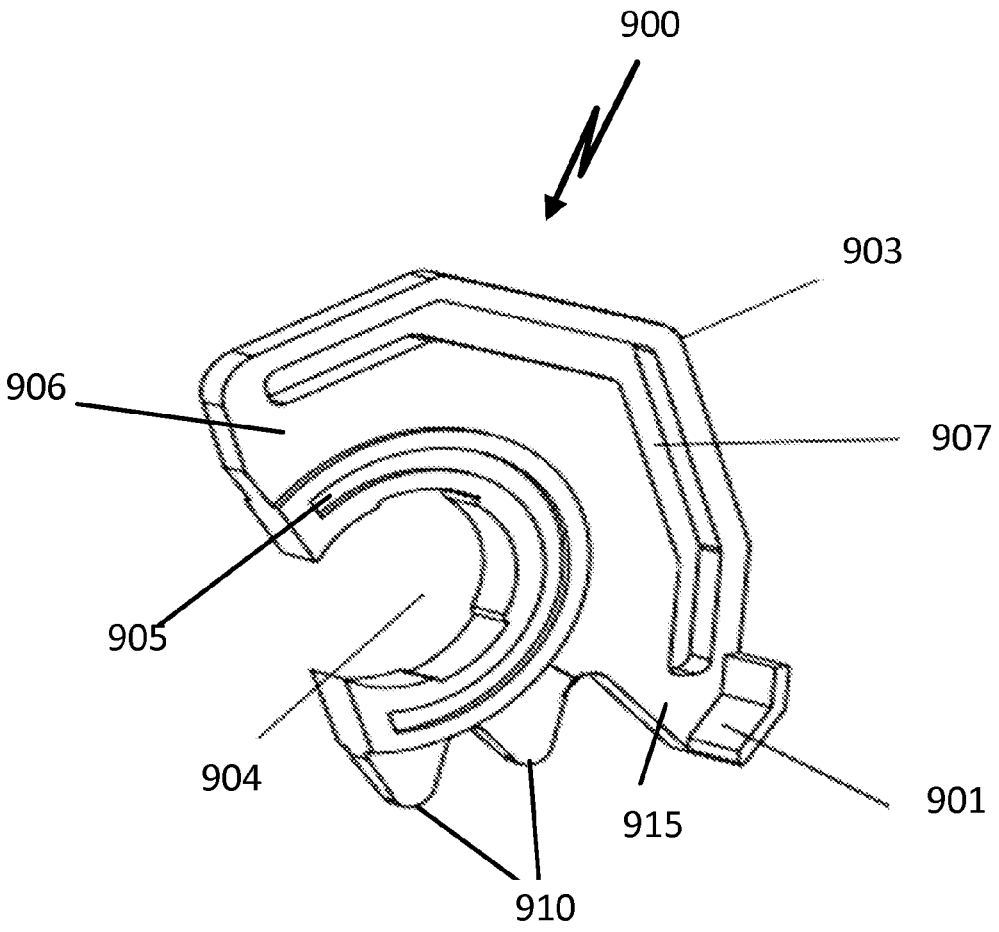
FIG. 9 is yet another embodiment of a cutting assembly brace, in accordance with the teachings of the present invention.

FIG. 9 is yet another embodiment of brace 900 which may be used on an arbor 805 (not shown) between cutting blades 635 (not shown). Brace 900 can have an overall shape similar to brace 400 and brace 700. Brace 900 can have C-shaped central opening 904, which can receive an arbor (not shown), and allow for rotational motion of the arbor. Brace 900 also can have a built-up portion around opening 904 into which a C-shaped slot 905 can be made. Although supporting a portion of arbor 805 (not shown), slot 905 can be resilient yet can resist translational motion of the arbor, including coaxial translational motion. In general, brace 900 can include body 906, tang 915, and a positioning device, such as tab 901 extending essentially perpendicularly from tang 915. Body 906 can be large enough to prevent cutting blades 635 (not shown) from coming into contact with tab 901. In some embodiments, tang 915 may not be distinct from body 906. As a group, positioning devices embodied by brace tabs 901 can impair a translational motion of the brace bodies 906. This, in turn, reduces translational motion of arbor 805 (not shown) and cutting blades 635 (not shown). Along spine 903 of body 906 can be a faceted C-shaped peripheral slot 907, formed to accommodate a cowling frame (not shown) such as rigid cowling frame 220, 520, 820 and providing horizontal support to braces 900. When a plurality of braces 900 are each disposed on a cowling frame by slot 907, with an arbor positioned in central opening 904 and cutting blades (not shown) being positioned between adjacent braces 900, X-Y-Z translational forces can be resisted and absorbed to allow the entrapped arbor to operate with reduced warpage under comminution stresses. Sound and vibration also may be attenuated. Brace 900 also can have protuberances 910 from body 906. Protuberances 910 may act to remove or push out particles of shreddant, preventing particles of shreddant from becoming caught between cutting blades 635 (not shown).

Figure 10:
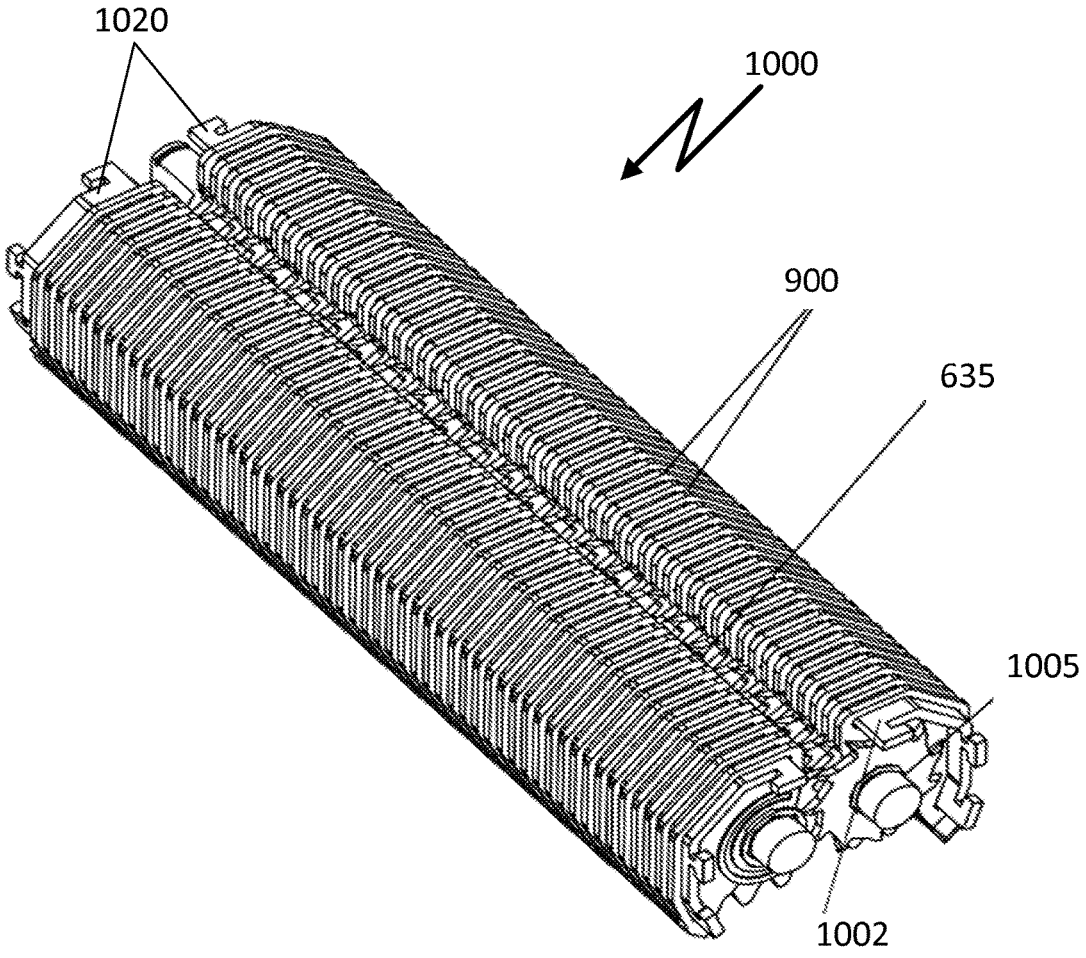
FIG. 10 is yet another embodiment of a paper shredder cutting assembly using the cutting assembly brace of FIG. 9, in accordance with the teachings of the present invention.

FIG. 10 illustrates yet another embodiment of main shredder cutting assembly 1000 for a paper shredder. Cutting assembly 1000 includes arbor 1005, a plurality of spaced apart cutting blades 635 disposed on arbor 1005, a rigid frame 1002 set apart from and parallel to arbor 1005, multiple braces 900 coupling arbor 1005 to frame 1002. Cutting blade assembly 1000 can be in the form of two counterposing cutting blade assemblies for comminuting material into shreddant. Rigid frame 1020 can be similar to cowling frame 220, 520, 820. Slot 907 of braces 900 is formed to receive a cowling frame, such as cowling frame 1020. Each of braces 900 can be disposed as a spacer adjacent to a respective one of the plurality of spaced-apart cutting blades 635, wherein the plurality of braces 900 support the arbor 1005. Typically, rigid frame 1020 and the braces 900 cooperate to reduce a translational force on arbor 1005, for example, an X-Y-Z translational force, while allowing arbor rotation. In general, motion in the up-and-down direction can be restricted by the cooperation of frame 1020 and braces 900, while motion in the left-and-right direction can be restricted by brace tabs 901. Fitting 1002 can be used to secure the horizontal rigid frame 1020 to a horizontal panel (such as panel 210).

Although the present invention has been described in terms of example embodiments, it is to be understood that neither the Specification nor the Drawings are to be interpreted as limiting. Other embodiments and configurations have been taught by the foregoing embodiments, and modifications and substitutions thereof are comprehended by this description. Various alternations and modifications are inherent, or will become apparent to those skilled in the art after reading the foregoing disclosure. Accordingly, it is intended that the appended claims be interpreted as covering all alternations and modifications that are encompassed by the spirit and the scope of the invention.

The invention claimed is:

1. A shredder cutting assembly, comprising:
an arbor;
a plurality of spaced-apart cutting blades disposed on the arbor;
a rigid frame set apart from and parallel to the arbor; and
a plurality of braces coupling the arbor to the frame, each of the braces being disposed as a spacer adjacent to a respective pair of the plurality of spaced-apart cutting blades,
wherein the plurality of braces support the arbor,
wherein each of the plurality of braces has a positioning device that is disposed parallel to the arbor and that restricts translational motion in the arbor when in contact with an adjacent brace, and
wherein the rigid frame and the plurality of braces cooperate to strengthen the arbor, while allowing rotation of the arbor.

2. The shredder cutting assembly of claim 1, wherein the plurality of braces are resilient.

3. The shredder cutting assembly of claim 1, wherein each of the plurality of braces has a slot shaped to accommodate at least a portion of the rigid frame.

4. The shredder cutting assembly of claim 3, wherein each of the plurality of braces has a C-shaped central slot to accommodate the arbor.

5. The shredder cutting assembly of claim 3, wherein each of the plurality of braces has a brace body, a brace tang extending from the brace body, and a brace tab extending perpendicularly from the brace tang, wherein each of the brace tabs is aligned with another along an edge of the rigid frame, the brace bodies are disposed as spacers between the plurality of cutting blades, and the brace tabs impair translational motion of the brace bodies.

6. The shredder cutting assembly of claim 5, wherein the body of each of the plurality of braces includes at least and protuberance.

7. The shredder cutting assembly of claim 3, wherein the slot further comprises at least one J-shaped slot.

8. The shredder cutting assembly of claim 3 wherein the slot comprises a peripheral slot.

9. The shredder cutting assembly of claim 8 wherein the peripheral slot comprises a faceted C-shaped peripheral slot sized and shaped to accept the rigid frame.

10. The shredder cutting assembly of claim 1, wherein the rigid frame and the plurality of braces cooperate to reduce a translational motion of the arbor.

11. The shredder cutting assembly of claim 1, wherein the rigid frame and the plurality of braces cooperate to impair coaxial translational motion in the plurality of spaced-apart cutting blades.

12. A paper shredder, comprising:
a motor;
gearing coupled to and driven by the motor;
a pair of counter-rotating arbors, driven by the gearing;
a respective plurality of spaced-apart cutting blades attached to move with each respective arbor; and
a respective plurality of braces interposed between the respective plurality of spaced-apart cutting blades and movably attached to the respective arbors,
wherein each of the braces has a vertical body, a tang extending from the vertical body, and a positioning device extending from the tang,
wherein each of the vertical body is sized to prevent the respective plurality of cutting blades from touching the respective positioning devices, and wherein the respective positioning devices on the plurality of braces cooperate with each other to reduce a translational motion of the respective arbor.

13. The paper shredder of claim 12, wherein the respective plurality of braces are resilient braces.

14. The paper shredder of claim 13, wherein the resilient braces are composed of a nylon-fiber material or an acrylonitrile butadiene styrene material.

15. The paper shredder of claim 13, further comprising:
a rigid frame set apart from and parallel to each arbor,
wherein each respective plurality of braces couples an arbor to the rigid frame, and each rigid frame and the respective plurality of braces cooperate to strengthen the arbor and to limit a translational motion of each arbor, while allowing rotational motion of each arbor.

16. The paper shredder of claim 12, wherein the positioning device comprises a cap-and-pin.

17. The paper shredder of claim 12, wherein the positioning device comprises a horizontal tab.

* * * * *